US011024215B2

(12) United States Patent
Chen et al.

(10) Patent No.: US 11,024,215 B2
(45) Date of Patent: Jun. 1, 2021

(54) DISPLAY PANEL HAVING DUAL-GATE STRUCTURE, CONTROL CIRCUIT, AND DISPLAY DEVICE

(71) Applicant: NOVATEK MICROELECTRONICS CORP., HsinChu (TW)

(72) Inventors: Hung-Hsiang Chen, Hsinchu (TW); Tso-Hua Chien, Hsinchu (TW); Huang-Chin Tang, Zhubei (TW)

(73) Assignee: NOVATEK MICROELECTRONICS CORP., Hsinchu (TW)

( * ) Notice: Subject to any disclaimer, the term of this patent is extended or adjusted under 35 U.S.C. 154(b) by 20 days.

(21) Appl. No.: 16/524,270

(22) Filed: Jul. 29, 2019

(65) Prior Publication Data

US 2020/0273394 A1 Aug. 27, 2020

Related U.S. Application Data

(60) Provisional application No. 62/808,875, filed on Feb. 22, 2019.

(51) Int. Cl.
*G09G 3/20* (2006.01)

(52) U.S. Cl.
CPC ..... *G09G 3/2074* (2013.01); *G09G 3/2022* (2013.01); *G09G 2300/0452* (2013.01); *G09G 2310/0264* (2013.01)

(58) Field of Classification Search
CPC ..... G09G 3/2074; G09G 3/2022; G09G 2300/0452; G09G 2310/0264
USPC ..... 345/204
See application file for complete search history.

(56) References Cited

U.S. PATENT DOCUMENTS

2009/0153532 A1* 6/2009 Chen ..... G09G 3/3685 345/204
2012/0098871 A1* 4/2012 Park ..... G09G 3/36 345/690
2012/0098891 A1 4/2012 Xie et al.
2015/0144946 A1 5/2015 Kusunoki et al.
2015/0187293 A1* 7/2015 Yoo ..... G09G 3/3614 345/694
2017/0243528 A1 8/2017 Ji et al.

FOREIGN PATENT DOCUMENTS

CN 105590600 A 5/2016
TW 200926125 A 6/2009

OTHER PUBLICATIONS

TW Office Action dated Aug. 27, 2020 in Taiwan application (No. 108132744).
TW Office Action dated Feb. 20, 2021 in Taiwan application (No. 108132744).

* cited by examiner

*Primary Examiner* — Mark Edwards
(74) *Attorney, Agent, or Firm* — McClure, Qualey & Rodack, LLP

(57) ABSTRACT

A dual-gate display panel, a control circuit, and a display device are provided. The display device includes the dual-gate display panel and the control circuit. The display panel includes a first subpixel, a second subpixel, a third subpixel, and a fourth subpixel, which are sequentially arranged along a first direction. The first subpixel and the third subpixel are electrically connected to a first source line. The second subpixel and the fourth subpixel are electrically connected to a second source line.

17 Claims, 12 Drawing Sheets

DISPLAY PANEL HAVING DUAL-GATE STRUCTURE, CONTROL CIRCUIT, AND DISPLAY DEVICE

This application claims the benefit of U.S. provisional application Ser. No. 62/808,875, filed Feb. 22, 2019, the disclosure of which is incorporated by reference herein in its entirety.

TECHNICAL FIELD

The disclosure relates in general to a dual-gate display panel, a control circuit, and a display device, and more particularly to a dual-gate display panel, a control circuit, and a display device capable of raising the quality of visual effects.

BACKGROUND

A display panel usually has M*N subpixels being arranged in a matrix of M columns and N rows. For a non-dual-gate display panel, the column number of the subpixels M is equivalent to the number of source lines J (that is, M=J), and the row number of the subpixels N is equivalent to the number of gate lines K (that is, N=K). In the specification, M, N, J, K are positive integers, and their lower case letters represent indexes of the components.

On the other hand, for a dual-gate (hereinafter, DG) display panel, the column number of the subpixels M is equivalent to two times of source lines J (that is, M=2*J), and the row number of the subpixels N is equivalent to the half of the number of gate lines K (that is, N=½*K). Alternatively speaking, for the DG display panel, the number of source lines (J) is halved, and the number of gate lines (K) is doubled.

As the number of the source lines (J) in the DG display panel is reduced, the number of the (source) circuits can be halved. Thus, the area and the cost of the source drivers can be reduced, and the screen-to-body ratio can be raised. Because the screen-to-body ratio is an essential factor for the small-sized display panel, the small-sized amorphous silicon (a-Si) display panels starts to adopt the DG structure.

For illustration purpose, the subpixels are represented in a coordinated notation to indicate their positions. For example, a subpixel SP(m, n) (m=1~M, and n=1~N) is located at the m-th column and the n-th row. The subpixel SP(m, n) is electrically connected to a j-th (j=1~J) source line and a k-th (k=1~K) gate line. In the specification, an identical notation is used for representing a signal line and the control signal being transmitted by the signal line. For example, the k-th gate line GL[k] transmits the k-th gate control signal GL[k].

FIGS. 1A and 1B (prior art) are schematic diagrams illustrating the subpixel layout of a conventional DG display panel. An example of the conventional DG display panel having M=4, N=4, J=2, K=8 is shown.

For illustration purpose, different patterns of screentone are applied to represent different colors. The vertical screentone represents the red color, the dotted screentone represents the green color, and the diagonal screentone represents the blue color. In the specification, each of the pixels is assumed to include a red subpixel (SPr), a green subpixel (SPg) and a blue subpixel (SPb). The data voltage received by the red, green, and blue subpixels are respectively represented as dVr, dVg, and dVb. It should be noted that the colors of the subpixels and their layout/configuration/sequence are not limited in practical application. In the specification, the circuits corresponding to the positive polarity (+) are shown in the grid, and the circuits corresponding to the negative polarity (−) have horizontal screentone.

FIGS. 1A and 1B show the polarities of the subpixels when an odd frame and an even frame are displayed, respectively. The duration for displaying an odd frame is defined as an odd frame duration (Tframe_odd), and the duration for displaying an even frame is defined as an even frame duration (Tframe_even). The lengths of the odd frame duration (Tframe_odd) and the even frame duration (Tframe_even) are equivalent. The polarities of all the subpixels are preferred to switch in the continuous frames.

The source lines S[1], S[2] are arranged vertically and parallel to each other while the gate lines GL[1]~GL[8] are arranged horizontally and parallel to each other. The source line S[1] is placed in between and electrically connected to the subpixels located in the first column (m=1) and the ones located in the second column (m=2), and the source line S[2] is placed in between and electrically connected to the subpixels located in the third column (m=3) and the ones located at the fourth column (m=4).

As shown in FIGS. 1A and 1B, the subpixels at the first row (SP(m, n), m=1~M and n=1) are sandwiched by the gate line GL[1] and the gate line GL[2]. That is, the gate lines GL[1], GL[2] are respectively disposed at the top side, and the bottom side of the subpixels disposed at the first row (SP(m, n), m=1~M and n=1). Similarly, the subpixels at the second row (SP(m, n), n=2) are sandwiched by the gate line GL[3] and the gate line GL[4]. That is, the gate lines GL[3], GL[4] are respectively disposed at the top side and the bottom side of the subpixels at the second row (SP(m,n), m=1~M and n=2).

The relationships between the data voltages being supplied by the driving circuits 101, 102, polarities of the data voltages, and the source lines from which the subpixels receive their data voltages during the odd frame duration (Tframe_odd) and the even frame duration (Tframe_even) are summarized in Table 1.

TABLE 1

| figure | frame duration | driving circuit | polarity of data voltage | data voltage to be provided | source line(s) being electrically connected to | subpixel(s) being electrically connected to |
|---|---|---|---|---|---|---|
| FIG. 1A | odd frame duration | driving circuit 101 | positive (+) | dVr_dft or dVg_dft | S[1] | SP(1, n) SP(2, n) |
| | | driving circuit 102 | negative (−) | dVb_dft or dVr_dft | S[2] | SP(3, n) SP(4, n) |
| FIG. 1B | even frame duration | driving circuit 101 | positive (+) | dVb_dft or dVr_dft | S[2] | SP(3, n) SP(4, n) |
| | | driving circuit 102 | negative (−) | dVr_dft or dVg_dft | S[1] | SP(1, n) SP(2, n) |

In the odd frame duration (Tframe_odd), each of the gate lines GL[k] (k=1~K) is alternatively set to a high voltage level (H) for a gate control duration Tgl. Once all the gate lines GL[k] (k=1~K) have been alternatively set to high voltage level (H), the even frame duration (Tframe_even) starts and the gate lines GL[k] (k=1~K) alternatively set to high voltage level (H) for a gate control duration Tgl again. The flow is repetitively performed.

During the odd frame duration (Tframe_odd) (see FIG. 1A), the source line S[1] receives data voltages having positive polarity (+) from the driving circuit 101, and the source line S[2] receives the data voltages having negative polarity (−) from the driving circuit 102. Thus, during the odd frame duration (Tframe_odd), the source line S[1] continuously provides data voltages having positive polarity (+) to subpixels at the first column (m=1) and the second column (m=2), and the source line S[2] continuously provides data voltages having negative polarity (−) to subpixels at the third column (m=3) and the fourth column (m=4).

During the even frame duration (Tframe_even) (see FIG. 1B), the source line S[1] receives data voltages having negative polarity (−) from the driving circuit 102, and the source line S[2] receives the data voltages having positive polarity (+) from the driving circuit 101. Thus, during the even frame duration (Tframe_even), the source line S[1] continuously provides data voltages having positive polarity (+) to subpixels at the third column (m=3) and the fourth column (m=4), and the source line S[2] continuously provides data voltages having negative polarity (−) to subpixels at the first column (m=1) and the second column (m=2).

The subpixels in the first column P(m,n) (m=1 and n=1~N) are enabled by the even-numbered gate lines GL[k] (k=even) to receive their data voltages. As the subpixels in the first column P(m,n) (m=1 and n=1~N) are red subpixel (SPr), to which the source line S[1] provides the red data voltages having positive polarity (+)dVr during the odd frame duration (Tframe_odd) and the source line S[1] provides the red data voltages having negative polarity (−)dVr during the even frame duration (Tframe_even).

The subpixels in the second column P(m,n) (m=2 and n=1~N) are enabled by the odd-numbered gate lines GL[k] (k=odd) to receive their data voltages. As the subpixels in the second column P(m,n) (m=2 and n=1~N) are green subpixel (SPg), to which the source line S[1] provides the green data voltages having positive polarity (+)dVg during the odd frame duration (Tframe_odd) and the source line S[1] provides the green data voltages having negative polarity (−)dVg during the even frame duration (Tframe_even).

The subpixels in the third column P(m,n) (m=3 and n=1~N) are enabled by the even-numbered gate lines GL[k] (k=even) to receive their data voltages. As the subpixels in the third column are blue subpixel (SPb), to which the source line S[2] provides the blue data voltages having negative polarity (−)dVb during the odd frame duration (Tframe_odd) and the source line S[2] provides the blue data voltages having positive polarity (+)dVb during the even frame duration (Tframe_even).

The subpixels in the fourth column P(m,n) (m=4 and n=1~N) are enabled by the odd-numbered gate lines GL[k] (k=odd) to receive their data voltages. As the subpixels in the fourth column are red subpixel (SPr), to which the source line S[2] provides the red data voltages having negative polarity (−)dVr during the odd frame duration (Tframe_odd) and the source line S[2] provides the red data voltages having positive polarity (+)dVr during the even frame duration (Tframe_even).

Please refer to FIGS. 1A and 1B together. Controls to the subpixels are basically identical in the odd frame duration (Tframe_odd) and the even frame duration (Tframe_even), except that the polarities of the data voltages are switched. Thus, only the panel control signals in the odd frame duration (Tframe_odd) are illustrated.

FIG. 2 (prior art) is a schematic waveform diagram showing the panel control signals to be applied to a display panel having the conventional DG structure. The horizontal axis represents different time points t0~t6. The frame duration between time point t0 to time point t6 is assumed to be an odd frame duration (Tframe_odd). The vertical axis shows gate control signals GL[1], GL[2], and source signals S[1], S[2]. The voltage levels of the gate lines GL[1], GL[2] determine which of the subpixels are enabled to receive the data voltages provided by the source lines S[1], S[2]. In the specification, it is assumed that the subpixels are enabled by high voltage level (H).

The odd frame duration (Tframe_odd) can be divided into N line control durations Tln (that is, Tframe_odd=N*Tln), a duration for controlling the subpixels located at the same row SP(1, n)~SP(M, n) for receiving their data voltages. Moreover, the line control duration Tln is equivalent to two times of the gate control duration Tgl (that is, Tln=2*Tgl). The gate control duration Tgl is a duration for controlling the subpixels located at the same row and electrically connected to the same gate line GL[k] (k=(n+1)/2 when n is odd, or k=n/2 when n is even).

In practical application, a horizontal synchronization Hsync duration may exist between every two continuous frame durations (Tframe_odd and/or Tframe_even), and vertical synchronization durations Vsync may exist between each line control duration Tln. For the sake of illustration, the horizontal and vertical synchronization durations Hsync, Vsync are not shown nor described.

During the gate control duration Tgc between time point t0 and time point t1, the gate line GL[1] is set to high voltage level (H), the subpixel SP(2, 1) receives its data voltage (+)dV21=(+)dVg through the source line S[1], and the subpixel SP(4, 1) receives its data voltage (−)dV41=(−)dVr) through the source line S[2]. During the gate control duration Tgc between time point t1 and time point t2, the gate line GL[2] is set to high voltage level (H), the subpixel SP(1, 1) receives its data voltage (+)dV11=(+)dVr through the source line S[1], and the subpixel SP(3, 1) receives its data voltage (−)dV31=(−)dVb through the source line S[2]. During the gate control duration Tgc between time point t2 and time point t3, the gate line GL[3] is set to high voltage level (H), the subpixel SP(2, 2) receives its data voltage (+)dV22=(+)dVg through the source line S[1], and the subpixel SP(4, 2) receives its data voltage (−)dV41=(−)dVr through the source line S[2]. During the gate control duration Tgc between time point t3 and time point t4, the gate line GL[4] is set to logic high voltage level (H), the subpixel SP(1, 2) receives its data voltage (+)dV12=(+)dVr through the source line S[1], and the subpixel SP(3, 2) receives its data voltage (−)dV32=(−)dVb through the source line S[2].

The subpixels at the same column but different row have similar operations. That is, they have the same color, and they receive their data voltages from the same source lines, except they are enabled by different gate lines. For example, although being respectively enabled by the gate lines GL[1], GL[3], both of the subpixel SP(2, 1), SP(2,2) are green subpixels (SPg) receiving their data voltages, that is, (+)dVg during the odd frame duration (Tframe_odd) and (−)dVg during the even frame duration (Tframe_even), from the source line S[1]. Similarly, although being respectively enabled by the gate lines GL[1], GL[3], both of the subpixel SP(4, 1), SP(4,2) are red subpixels (SPr) receiving their data voltages, that is, (−)dVr during the odd frame duration (Tframe_odd) and (+)dVr during the even frame duration (Tframe_even), from the source line S[2].

Please refer to FIGS. 1A, 1B, and 2 together. For the conventional DG display panel, the polarities of the subpixels are switched in every two columns because each source line is electrically connected to subpixels located at two adjacent columns. Generally, the luminance of the pixel is determined by an average value of the data voltage having positive polarity (+) and the data voltage having a negative polarity (−). Ideally, for the same grey level, magnitudes of the data voltages having the positive polarity (+) and the negative polarity (−) should be identical to assure that the luminance of the same subpixel should remain consistent in different frame durations, regardless the polarity changes of the data voltages.

As illustrated above, the subpixels at every two adjacent columns are controlled by a driving circuit providing data voltages having positive polarity in one frame duration and by another driving circuit having negative polarity in another frame duration. However, the driving capabilities of different driving circuits might not be symmetric, and this results in degrading the visual effects.

For the sake of illustration, the input image being displayed by the DG display panel can be assumed to be a solid color picture. Thus, in one frame duration, the magnitudes of the data voltages received by the subpixels in the same color should be equivalent. Moreover, the data voltages received by each individual subpixel in the odd frame duration (Tframe_odd) and the even frame duration (Tframe_even) should be equivalent, although the data voltages are generated by different driving circuits.

In an ideal case, the magnitude of the data voltage being transmitted to the subpixel SP(1,1) should be equivalent to the magnitude of the data voltage being transmitted to the subpixel SP(4,1), despite that the data voltages received by the subpixels SP(1, 1), SP(4, 1) are provided by the driving circuit 101, 102, respectively. In addition, the data voltages received by the subpixel SP(1, 1) during the odd frame duration (Tframe_odd) and the even frame duration (Tframe_even) should be equivalent, despite that these data voltages are originated from different driving circuits 101, 102.

However, the driving capabilities of the driving circuits 101, 102 might not match to each other. Thus, the luminance of the subpixels SP(1, 1), SP(4, 1) during the same frame duration might not be the same, and the luminance of the subpixel SP(1, 1) in different frame durations might not be the same either. Consequentially, a vertical pattern phenomenon with a width of every two subpixels might appear on the DG display panel because every two subpixels share the same source line being controlled by different driving circuits whose driving capabilities are asymmetric. Thus, the screen might have column flickering on it, especially when the position of the display panel is shaken by the influence of the external force.

SUMMARY

The disclosure is directed to a dual-gate display panel, a control circuit, and a display device. While displaying solid color pictures, data voltages being supplied to the source lines swift in between the same magnitude but opposite polarities. With the DG structure, the width of the vertical pattern caused by clamping between the positive and negative frames is halved so that the visual effect is improved.

According to one embodiment, a display panel is provided. The display panel includes a first subpixel, a second subpixel, a third subpixel, and a fourth subpixel. The first subpixel and the third subpixel are electrically connected to a first source line. The second subpixel and the fourth subpixel are electrically connected to a second source line. The first, the second, the third, and the fourth subpixels are sequentially arranged along a first direction.

According to another embodiment, a control circuit is provided. The control circuit is electrically connected to a display panel including a first subpixel, a second subpixel, a third subpixel, and a fourth subpixel. The first, the second, the third, and the fourth subpixels are sequentially arranged along a first direction. The control circuit includes a source driver. The source driver includes a first source line being electrically connected to the first subpixel and the third subpixel, a second source line being electrically connected to the second subpixel and the fourth subpixel.

According to an alternative embodiment, a display device is provided. The display device includes a display panel and a control circuit. The display panel includes a first subpixel, a second subpixel, a third subpixel, and a fourth subpixel. The first, the second, the third, and the fourth subpixels are sequentially arranged along a first direction. The control circuit includes a source driver, and the source driver includes a first source line, a second source line, a first driving circuit and a second driving circuit. The first source line is electrically connected to the first subpixel and the third subpixel, and the second source line is electrically connected to the second subpixel and the fourth subpixel. The first driving circuit is electrically connected to the first source line during a first gate control duration and electrically connected to the second source line during a second gate control duration. The second driving circuit is electrically connected to the second source line during the first gate control duration and electrically connected to the first source line during the second gate control duration.

Figure 1A:
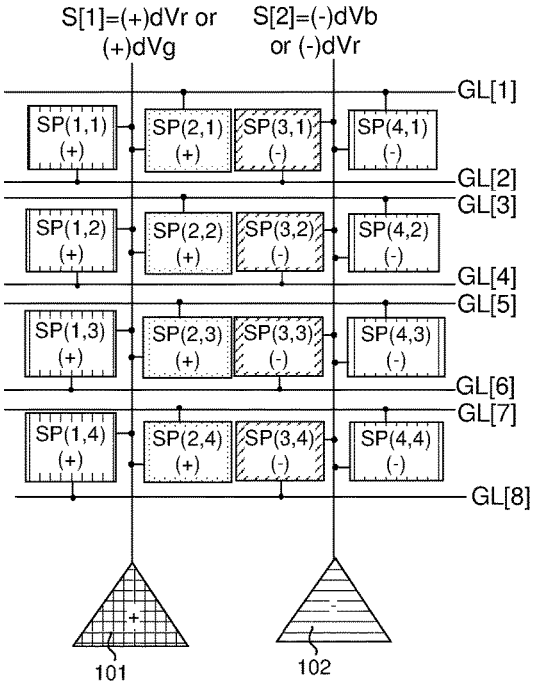
FIG. 1A (PRIOR ART)
FIGS. 1A and 1B (prior art) are schematic diagrams illustrating subpixel layout in a conventional DG display panel.
Figure 1B:
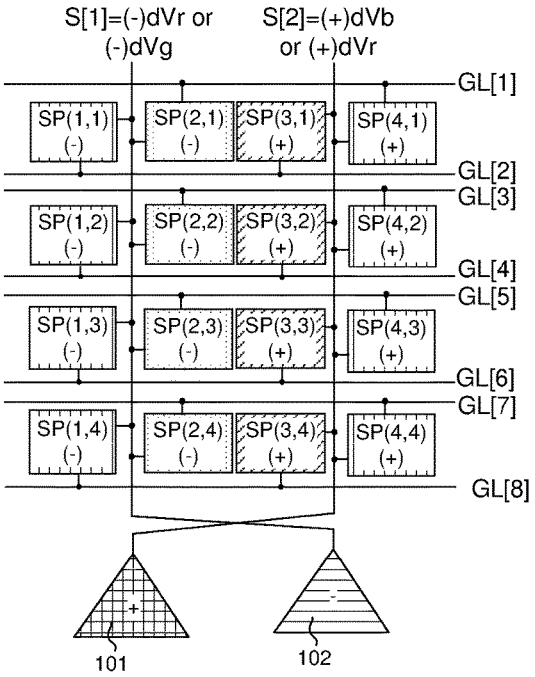
FIG. 1B (PRIOR ART)
Figure 2:
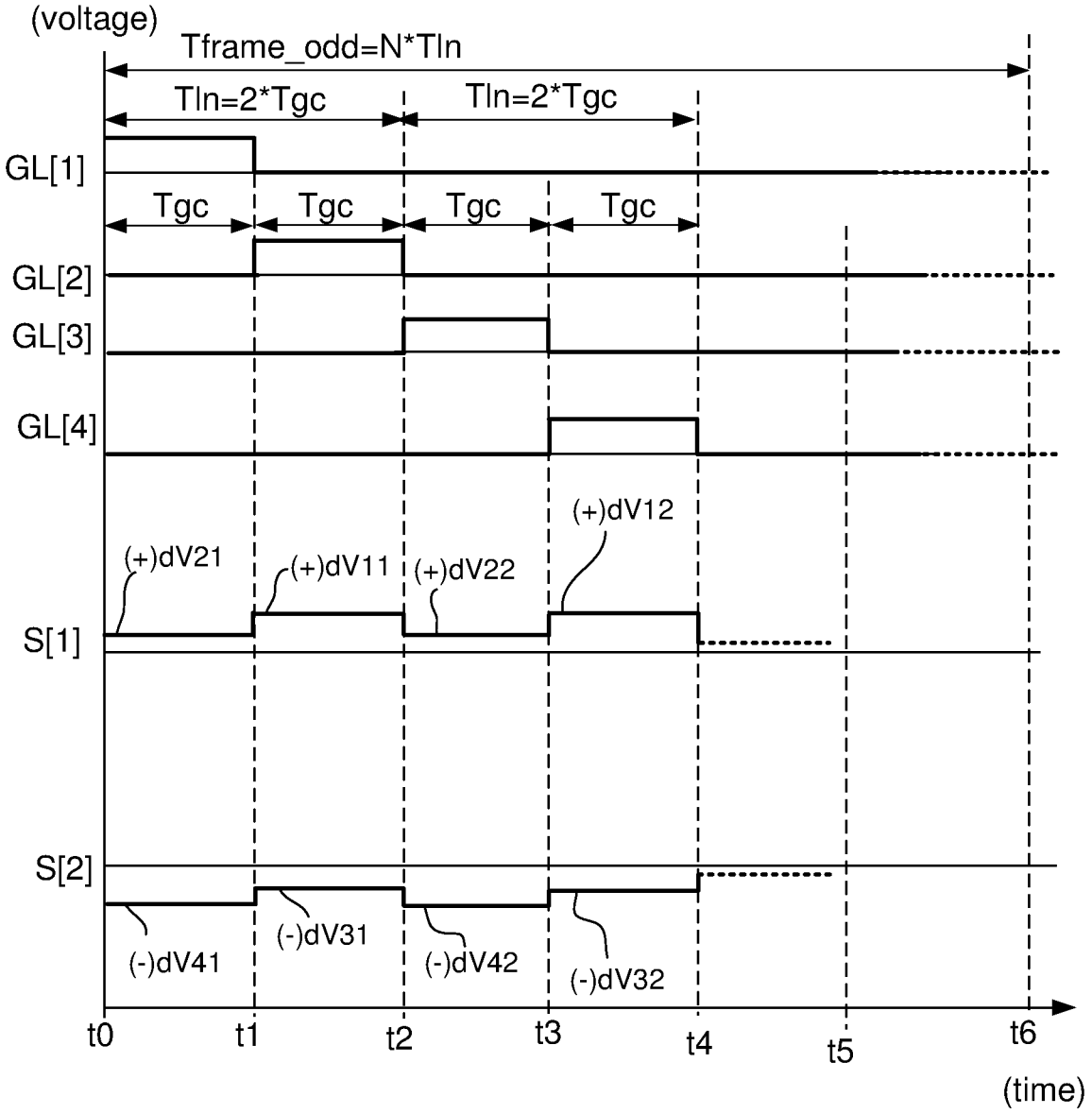
FIG. 2 (PRIOR ART)
FIG. 2 (prior art) is a schematic waveform diagram showing the panel control signals to be applied to the conventional DG display panel for displaying the solid color picture.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

DETAILED DESCRIPTION

In the specification, a DG display panel is provided. The layout of the DG display panel is designed so that the J source lines are electrically connected to the subpixels in an interleaving manner. That is, each of the odd-numbered source lines S[j] (j=odd) is electrically connected to the subpixels which are respectively located at two odd-numbered columns P(m, n) (m=2*j−1 or m=2*j+1), and each of the even-numbered source lines S[j](j=even) is electrically connected to the subpixels which are respectively located at two even-numbered columns P(m, n) (m=2*(j−1) or m=2*j). For example, the source line S[1] is electrically connected to the subpixels at the first column (m=1) and the third column (m=3), and the source line S[2] is electrically connected to the subpixels at the second column (m=2) and the fourth column (m=4).

Figure 3:
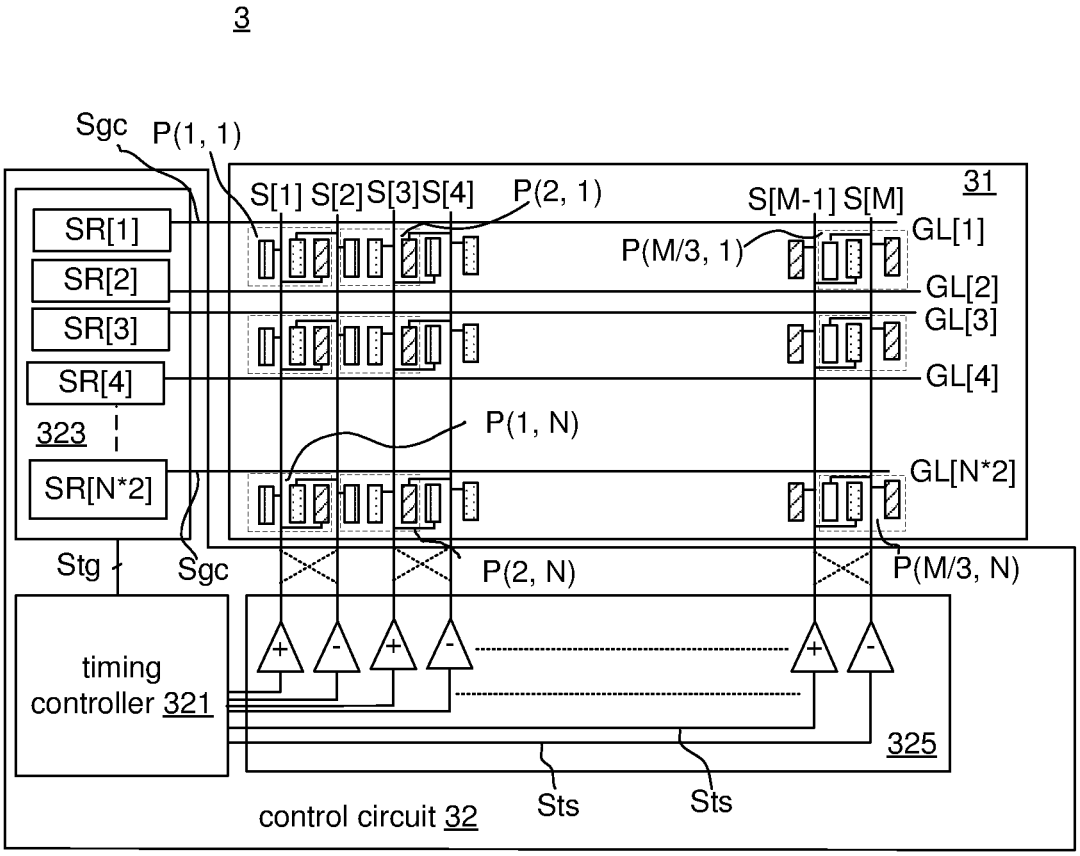
FIG. 3 is a schematic diagram of a display device according to the embodiment of the present disclosure.

FIG. 3 is a schematic diagram of a DG display device according to the embodiment of the present disclosure. The display device 3 includes a DG display panel 31 and a control circuit 32, and the control circuit 32 further includes a timing controller 321, a source driver 325, and a gate driver 323. The timing controller 321 generates and transmits gate timing control signals Stg and the source timing control signals Sts to the source driver 325 and the gate driver 323, respectively. Then, the driving circuits in the source driver 325 and the shift control circuits in the gate driver 323 respectively transmit the data voltages dV and gate control signals Sgc to the subpixels. The data voltages dV and gate control signals Sgc are defined as panel control signals. Detail illustrations related to the timing control signals and the panel control signals are omitted to avoid redundancy.

The subpixels are arranged in a matrix with M columns and N rows, and every three subpixels at the same row jointly form a pixel (P). Thus, the display panel includes pixels being arranged in M/3 columns and N rows. Ideally, M is a multiple of 3. It is assumed that each of the pixels P(1, 1), P(2, 1), P(1, 1), P(2, N), P(M/3, 1), P(M/3, N) include three subpixels (that is, a red subpixel (SPr), a green subpixel (SPg), and a blue subpixel SPb). Although the sequence of the subpixels is assumed to be R-G-B in the exemplary DG structures, other sequences of subpixels such as G-B-R, G-R-B, B-G-R, can be used as well.

The gate driver 323 includes shift control circuits SR[k] (k=1~K) and gate lines GL[k] (k=1~K). The shift control circuits SR[k] (k=1~K) are respectively electrically connected to the gate lines GL[k] (k=1~K). Every two adjacent gate lines are separately arranged at the upper side and the lower side of the subpixels located at the same row. The interconnections between the gate lines GL[k] (k=1~K) and the subpixels SP(m, n) (m=1~M, n=1~N) may vary with different exemplary DG structures.

The source driver 325 includes J source driving circuits, source lines S[j] (j=1~J), and M switches (M=2*J). Every two adjacent source lines can be considered as a pair, and every four switches are jointly used with a pair of the source lines. The connections and correspondences between the source lines and the switches are shown in FIG. 4.

Figure 4:
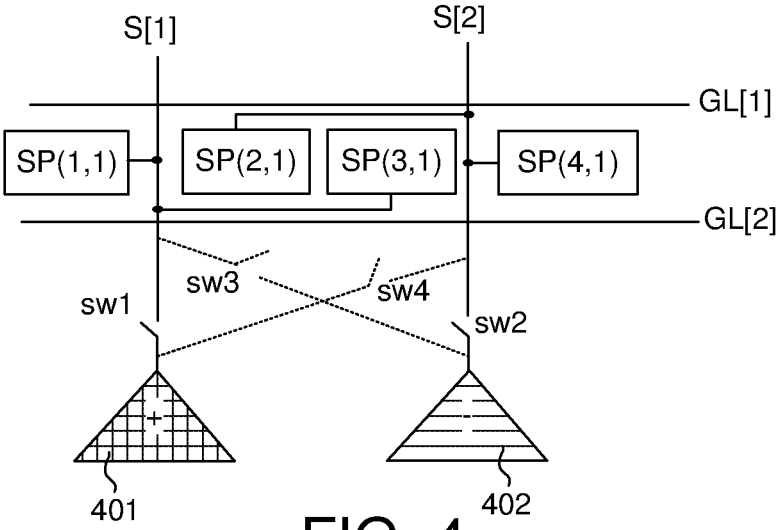
FIG. 4 is a schematic diagram illustrating an exemplary DG structure of the subpixels, source lines, gate lines, and switches.

FIG. 4 is a schematic diagram illustrating the common part of the embodiments according to the embodiments of the present disclosure. According to the embodiments of the present disclosure, the layout of the subpixels and associated interconnections is repeated in a unit of every four subpixels. Alternatively speaking, every four horizontally adjacent subpixels have similar layouts and similar interconnections with the source lines and gate lines. Thus, four subpixels SP(1, 1)~SP(4, 1) are shown, together with two gate lines GL[1], GL[2], two source lines S[1], S[2], four switches sw1, sw2, sw3, sw4, and two driving circuits 401, 402.

In all the exemplary DG structures, each of the odd-numbered source lines (S[j], j=odd) is electrically connected to the subpixels located at two odd-numbered columns P(m, n) (m=j*2−1 or m=j*2+1), and each of the even-numbered source lines (S[j], j=even) is electrically connected to the subpixels located at two even-numbered columns P(m, n) (m=(j−1)*2 or m=j*2). For example, the source line S[1] is electrically connected to the subpixels P(m, n) (m=1 or m=3), and the source line S[2] is electrically connected to the subpixels P(m, n) (m=2 or m=4).

The subpixel SP(m, n) is electrically connected to one of the source lines S[j] (j=(m+1)/2 or j=(m−1)/2) when m is odd. For example, the subpixels located in the first column (m=1) and the third column (m=3) are electrically connected to the source line S[1]. On the other hand, the subpixel SP(m, n) is electrically connected to one of the source lines S[j] (j=m/2+1 or j=m/2) when m is even. For example, the subpixels located in the second column (m=2) and the fourth column (m=4) are electrically connected to the source line S[2]. The connections between the subpixels SP(1, 1), SP(2, 1), SP(3, 1), SP(4, 1) and the source lines S[1], S[2] are summarized in Table 2.

TABLE 2

| | subpixels | | | |
|---|---|---|---|---|
| | SP(1, 1) | SP(2, 1) | SP(3, 1) | SP(4, 1) |
| source line | S[1] | S[2] | S[1] | S[2] |

The gate lines GL[k] (k=1~K) are parallel to the first direction (for example, horizontal direction), and the source lines S[j] (j=1~J) are parallel to a second direction (for example, vertical direction). The first direction and the second direction are orthogonal. The gate line GL[k] is placed along the upper side of the subpixels SP(m, n) (n=(k+1)/2) when k is odd, and the gate line GL[k] is placed along the lower side of the subpixels SP(m, n) (n=k/2) when k is even. For example, the gate line GL[1] is placed along the upper side of the subpixel SP(m, 1), and the gate line GL[2] is placed along the lower side of the subpixel SP(m, 1).

Depending on a different design, the interconnections between the subpixels SP(1,1)~SP(4,1) and the gate lines GL[1], GL[2] may vary. Whereas, the interconnections between the subpixels SP(1, 1)~SP(4, 1) and the source lines S[1], S[2] n different exemplary DG structures are similar. That is, the subpixels SP(1, 1), SP(3, 1) are always electrically connected to the source line S[1], and the subpixels SP(2, 1), SP(4, 1) are always electrically connected to the source line S[2]. The internal connections between the subpixel SP(3, 1) and the source line S[1] might be disposed at the upper side or lower side of the subpixel SP(2,1), and the internal connections between the subpixel SP(2, 1) and the source line S[2] might be disposed at the upper side or lower side of the subpixel SP(3, 1).

The switch sw1 is electrically connected to the driving circuit 401 and the source line S[1], the switch sw2 is electrically connected to the driving circuit 402 and the source line S[2], the switch sw3 is electrically connected to the driving circuit 402 and the source line S[1], and the switch sw4 is electrically connected to the driving circuit 401 and the source line S[2]. When a switch is turned on, the driving circuit and the source line at its two terminals are conducted. The controls of switches statuses are summarized in Table 3. The switching statuses of the switches sw1, sw2 are synchronized and opposite to those of the switches sw3, sw4.

TABLE 3

| | switches | | | |
|---|---|---|---|---|
| | sw1 | sw2 | sw3 | sw4 |
| odd frame duration | ON | | OFF | |
| even frame duration | OFF | | ON | |

For illustration purpose, the DG display panels are assumed to display a solid color picture having a default color. The default color is generated by a mixture of the red light emitted by the red subpixel (SPr), the green light emitted by the green subpixel (SPg), and the blue light emitted by the blue subpixel (SPb). To display the default color, the luminance of all the red subpixels (SPr) should be the same, the luminance of all the green subpixels (SPg) should be the same, and luminance of all the blue subpixels (SPb) should be the same. Thus, all the red subpixels (SPr) should receive a default red data voltage dVr_dft, all the green subpixels (SPg) should receive a default green data voltage dVg_dft, and all the blue subpixels (SPb) should receive a default blue data voltage dVb_dft. In the practical application, the magnitudes of the default data voltages (dVr_dft, dVg_dft, dVb_dft) should be determined by the grey levels of the input picture.

In the following embodiments, statuses of the subpixels (SP) are distinguished by different styles of edges. The subpixels (SP) having dotted edges are the ones have not received their data voltages. The subpixels (SP) having thick solid edges are the ones which are currently receiving their data voltages from the driving circuits. The subpixels (SP) having thin solid edges are the ones who have received their data voltage before.

Furthermore, the gate lines being set to high voltage level (H) are shown in thick solid lines. Moreover, the data voltages being supplied to the subpixels during the odd frame duration (Tframe_odd) and the even frame duration (Tframe_even) are notated without and with an apostrophe, respectively. For example, dV31 and dV31' respectively represent the data voltage being supplied to the subpixel SP(3, 1) during the odd frame duration (Tframe_odd) and the even frame duration (Tframe_even). One of the data voltages dV31, dV31' has the positive polarity (+) and the other one of the data voltages dV31, dV31' has the negative polarity (−), depending on the practical application.

Figure 5A:
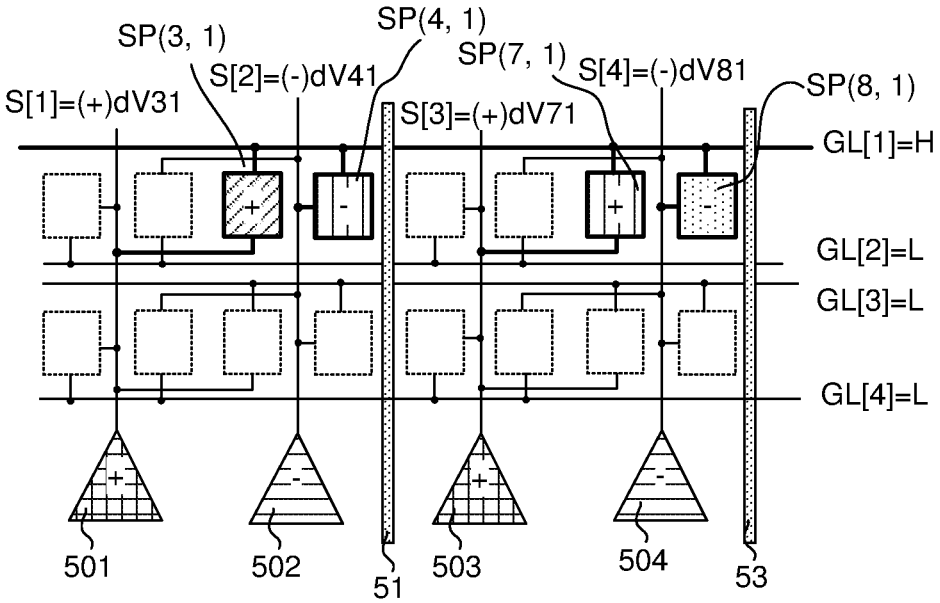
FIG. 5A is a schematic diagram illustrating the first exemplary DG structure when the gate line GL[1] is set to high voltage level (H) during the odd frame duration (Tframe_odd).
Figure 5B:
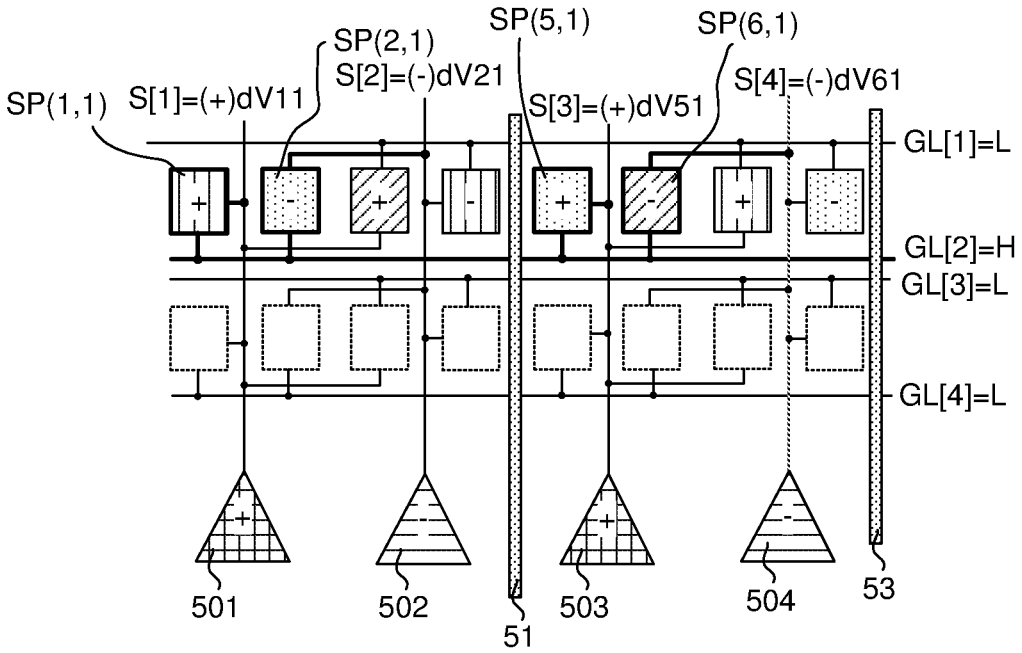
FIG. 5B is a schematic diagram illustrating the first exemplary DG structure when the gate line GL[2] is set to logic voltage level (H) during the odd frame duration (Tframe_odd).
Figure 5C:
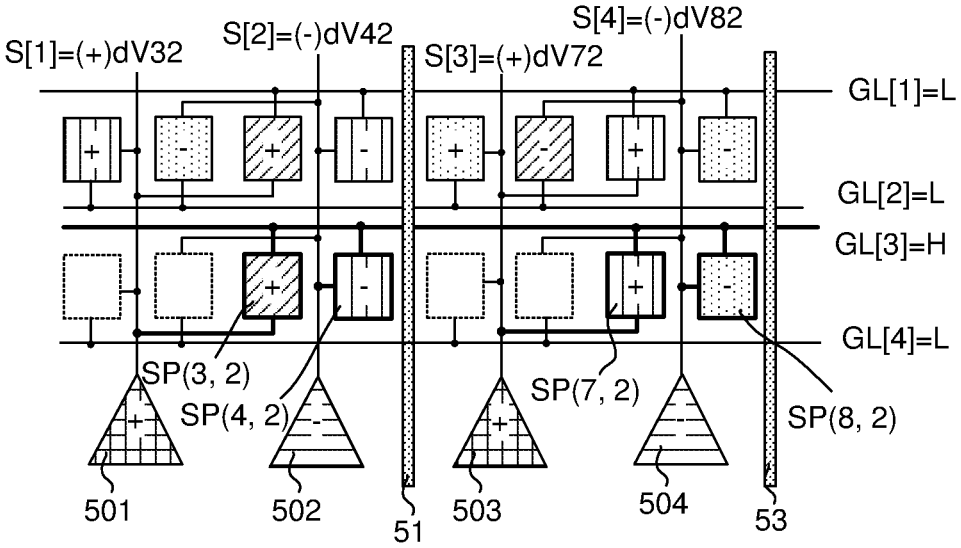
FIG. 5C is a schematic diagram illustrating the first exemplary DG structure when the gate line GL[3] is set to high voltage level (H) during the odd frame duration (Tframe_odd).
Figure 6A:
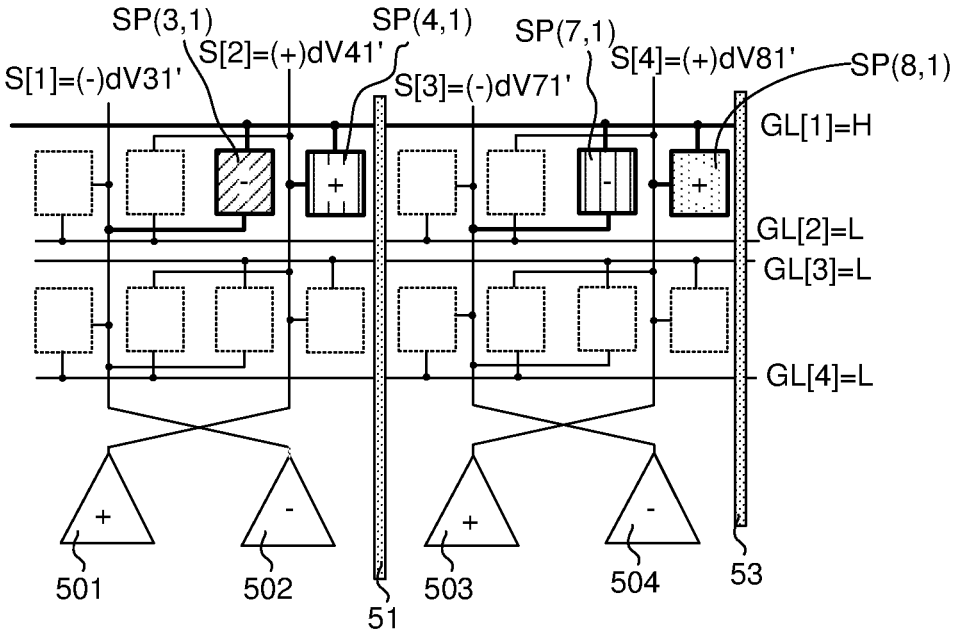
FIG. 6A is a schematic diagram illustrating the first exemplary DG structure when the gate line GL[1] is set to high voltage level (H) during the even frame duration (Tframe_even).
Figure 6B:
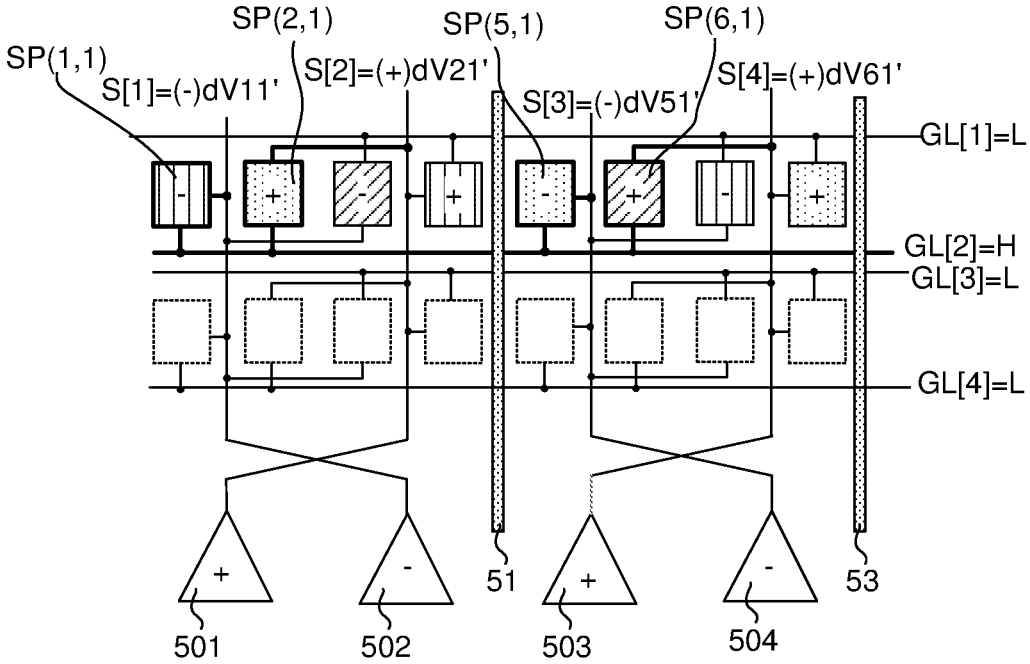
FIG. 6B is a schematic diagram illustrating the first exemplary DG structure when the gate line GL[2] is set to high voltage level (H) during the even frame duration (Tframe_even).

FIGS. 5A~5C, 6A, and 6B represent different operation states of a first exemplary DG structure. FIGS. 5A~5C are corresponding to the odd frame duration (Tframe_odd) and FIGS. 6A and 6B are corresponding to the even frame duration (Tframe_even). In FIGS. 5A~5C, the source lines S[1], S[2], S[3], S[4] are respectively electrically connected to the driving circuits 501, 502, 503, 504. In FIGS. 6A and 6B, the source lines S[1], S[2] are crossly electrically connected to the driving circuits 501, 502, and the source lines S[3], S[4] are crossly electrically connected to the driving circuits 503, 504. The layout of the subpixels and associated interconnections is repeated in a unit of every four subpixels. Therefore, the layout of the subpixels SP(1, 1)~SP(4, 1) are similar to the layout of the subpixels SP(5, 1)~SP(8, 1) and the layout of the subpixels SP(1,2)~SP(4, 2).

FIG. 5A is a schematic diagram illustrating the first exemplary DG structure when the gate line GL[1] is set to high voltage level (H) during the odd frame duration (Tframe_odd). As the gate line GL[1] is set to high voltage level (H), the subpixels connected to the gate line GL[1], that is, subpixels SP(3, 1), SP(4, 1), SP(7, 1), SP(8, 1), receive their data voltages (dV31, dV41, dV71, dV81).

As a blue subpixel (SPb), the subpixel SP(3, 1) receives the data voltage dV31 having a magnitude of default blue data voltage dVb_dft and positive polarity (+) from the driving circuit 501. As a red subpixel (SPr), the subpixel SP(4, 1) receives the data voltage dV41 having a magnitude of default red data voltage dVr_dft and negative polarity (−) from the driving circuit 502. As a red subpixel (SPr), the subpixel SP(7, 1) receives the data voltage dV71 having a magnitude of default red data voltage dVr_dft and positive polarity (+) from the driving circuit 503. As a green subpixel (Spg), the subpixel SP(8, 1) receives the data voltage dV81 having a magnitude of default green data voltage dVg_dft and negative polarity (−) from the driving circuit 504.

FIG. 5B is a schematic diagram illustrating the first exemplary DG structure when the gate line GL[2] is set to high voltage level (H) during the odd frame duration (Tframe_odd). As the gate line GL[2] is set to high voltage level (H), the subpixels SP(1, 1), SP(2, 1), SP(5, 1), SP(6, 1) being electrically connected to the gate line GL[2] are enabled to receive their data voltages dV11, dV21, dV51, dV61.

As a red subpixel (SPr), the subpixel SP(1, 1) receives the data voltage dV11 having a magnitude of default red data voltage dVr_dft and positive polarity (+) from the driving circuit 501. As a green subpixel (SPg), the subpixel SP(2, 1) receives a magnitude of default green data voltage dVg_dft and the data voltage dV21 having a negative polarity (−) from the driving circuit 502. As a green subpixel (SPg), the subpixel SP(5, 1) receives the data voltage dV51 having a magnitude of default green data voltage dVg_dft and positive polarity (+) from the driving circuit 503. As a blue subpixel(SPb), the subpixel SP(6, 1) receives the data voltage dV61 having a magnitude of default blue data voltage dVb_dft and negative polarity (−) from the driving circuit 504.

FIG. 5C is a schematic diagram illustrating the first exemplary DG structure when the gate line GL[3] is set to high voltage level (H) during the odd frame duration (Tframe_odd). As the gate line GL[3] is set to high voltage level (H), the subpixels SP(3, 2), SP(4, 2), SP(7, 2), SP(8, 2) being electrically connected to the gate line GL[3] are enabled to receive their data voltages dV32, dV42, dV72, dV82.

As a blue subpixel (SPb), the subpixel SP(3, 2) receives the data voltage dV32 having a magnitude of default blue data voltage dVb_dft and positive polarity (+) from the driving circuit 501. As a red subpixel (SPr), the subpixel SP(4, 2) receives the data voltage dV42 having a magnitude of default red data voltage dVr_dft and negative polarity (−) from the driving circuit 502. As a red subpixel (SPr), the subpixel SP(7, 2) receives the data voltage dV71 having a magnitude of default red data voltage dVr_dft and positive polarity (+) from the driving circuit 503. As a green subpixel (SPg), the subpixel SP(8, 2) receives the data voltage dV81 having a magnitude of default green data voltage dVg_dft and negative polarity (−) from the driving circuit 504.

Please refer to FIGS. 5A and 5C together. The operations of panel control signals related to the subpixels at the third row in FIG. 5C are similar to those at the first row in FIG. 5A.

FIG. 6A is a schematic diagram illustrating the first exemplary DG structure when the gate line GL[1] is set to high voltage level (H) during the even frame duration (Tframe_even). Please refer to FIGS. 5A and 6A together. In FIG. 6A, the voltage levels of the gate lines GL[1], GL[2], the subpixels being enabled for receiving data voltages SP(3,1), SP(4,1), SP(7,1), SP(8,1), the data voltages being supplied to the subpixels dVb_dft, dVr_dft, dVr_dft, dVg_dft, and the source lines transmitting the data voltage S[1], S[2] are the same as the ones in FIG. 5A, but the polarities of these data voltages are swapped.

FIG. 6B is a schematic diagram illustrating the first exemplary DG structure when the gate line GL[2] is set to high voltage level (H) during the even frame duration (Tframe_even). Please refer to FIGS. 5B and 6B together. In FIG. 6B, the voltage levels of the gate lines GL[1], GL[2], the subpixels being enabled for receiving data voltages SP(1,1), SP(2,1), SP(5,1), SP(6,1), the data voltages being supplied to the subpixels dVr_dft, dVg_dft, dVg_dft, dVb_dft, and the source lines transmitting the data voltage S[1], S[2] are the same as the ones in FIG. 5B, but the polarities of these data voltages are swapped.

In FIGS. 5A~5C, 6A and 6B, the touch sensing electrode 51 is formed in between the subpixels at the fourth column SP(m, n) (m=4 and n=1~N) and the subpixels at the fifth column SP(m, n) (m=5 and n=1~N), and the touch sensing electrode 53 is formed at the right side of the subpixels at the eighth column SP(m, n) (m=8 and n=1~N). As the touch sensing electrodes 51, 53 do not cross over any of the source lines S[1], S[2], nor the interconnections between the source lines S[1], S[2] and the subpixels SP(m, n) (m=1~8 and n=1~2), such layout plan can simplify the manufacturing procedure of the DG display panel.

Figure 7:
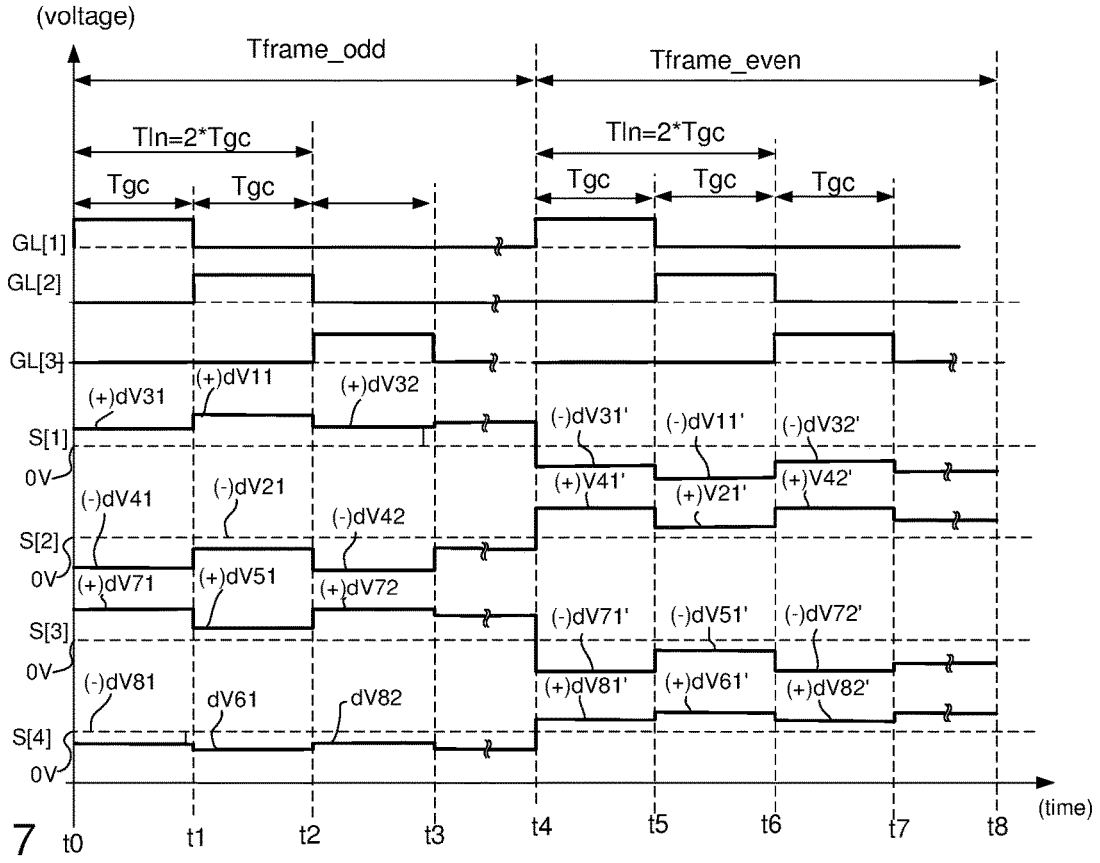
FIG. 7 is a waveform diagram illustrating changes in the panel control and subpixels shown in FIGS. 5A~5C, 6A, and 6B.

FIG. 7 is a waveform diagram illustrating changes in the panel control signals and subpixels shown in FIGS. 5A~6B. Please refer to FIGS. 5A~5C, 6A, 6B, and 7 together. In FIG. 7, the duration between time point t0 and time point t4 corresponds to the odd frame duration (Tframe_odd), and the duration between the time point t4 to the time point t8 corresponds to the even frame duration (Tframe_even). For both the odd frame duration (Tframe_odd) and the even frame duration (Tframe_even), N rows (lines) of subpixels should be respectively enabled. Therefore, both the odd frame duration (Tframe_odd) and the even frame duration (Tframe_even) include N line control durations Tln (Tframe_odd=Tframe_even=N*Tln). Furthermore, each of the line control duration Tln includes two gate control durations Tgc.

Please refer to FIGS. 5A, 6A, and 7 together. FIGS. 5A and 6A are corresponding to the duration from the time point t0 to the time point t1 and the duration from the time point t4 to time point t5 in FIG. 7, respectively. In FIGS. 5A and 6A, the settings of the source lines S[1]~S[4], gate lines GL[1]~GL[4] and subpixels SP(3, 1), SP(4, 1), SP(7, 1), SP(8, 1) are similar, but the connections between the source lines S[1]~S[4] and driving circuits 501~504 and polarities of the transmitted data voltages are changed. For the sake of comparison, the data voltages being supplied to the subpixels in FIGS. 5A and 6A are summarized in Table 4.

TABLE 4

| | | data voltages | | | |
|---|---|---|---|---|---|
| | | FIG. 5A (duration t0~t1 in FIG. 7) | FIG. 6A (duration t3~t4 in FIG. 7) | subpixel receiving data voltage | magnitude of data voltage |
| source lines S[j] | j = 1 | (+)dV31 | (−)dV31' | SP(3, 1) | dVb_dft |
| | j = 2 | (−)dV41 | (+)dV41' | SP(4, 1) | dVr_dft |
| | j = 3 | (+)dV71 | (−)dV71' | SP(7, 1) | dVr_dft |
| | j = 4 | (−)dV81 | (+)dV81' | SP(8, 1) | dVg_dft |

Please refer to FIGS. 5B, 6B, and 7 together. FIGS. 5B and 6B are corresponding to the duration from the time point t1 to the time point t2 and the duration from the time point t5 to time point t6 in FIG. 7, respectively. In FIGS. 5B and 6B, the settings of the source lines S[1]~S[4], gate lines GL[1]~GL[4] and subpixels SP(1, 1), SP(2, 1), SP(5, 1), SP(6, 1) are similar, but connections between the source lines S[1]~S[4] and driving circuits 501~504 and polarities of the transmitted data voltages are changed. For the sake of comparison, the data voltages being supplied to the subpixels in FIGS. 5B and 6B are summarized in Table 5.

TABLE 5

| | | Data voltages | | | |
|---|---|---|---|---|---|
| | | FIG. 5B (duration t1~t2 in FIG. 7) | FIG. 6B (duration t5~t6 in FIG. 7) | subpixel receiving data voltage | magnitude of data voltage |
| source lines S[j] | j = 1 | (+)dV11 | (−)dV11' | SP(1, 1) | dVr_dft |
| | j = 2 | (−)dV21 | (+)dV21' | SP(2, 1) | dVg_dft |
| | j = 3 | (+)dV51 | (−)dV51' | SP(5, 1) | dVg_dft |
| | j = 4 | (−)dV61 | (+)dV61' | SP(6, 1) | dVb_dft |

Please refer to FIGS. 5A~5C, 6A, 6B, and 7 together. The interconnections between the subpixel SP(m, n), the source line S[j] and the gate line GL[k] based on the first exemplary DG structure are be summarized in Table 6.

TABLE 6

| first exemplary DG structure | | gate line GL[k] | |
|---|---|---|---|
| FIGS. 5A~5C, 6A, 6B | | k = odd | k = even |
| source line | j = odd | j = (m − 1)/2<br>k = (n*2) − 1 | j = (m + 1)/2<br>k = n*2 |

TABLE 6-continued

| first exemplary DG structure | | gate line GL[k] | |
|---|---|---|---|
| FIGS. 5A~5C, 6A, 6B | | k = odd | k = even |
| S[j] | j = even | j = m/2<br>k = n*2 − 1 | j = m/2 + 1<br>k = n*2 |

The operations of the gate lines GL[1], GL[2], source lines S[1], S[2] and the subpixels SP(1, 1), SP(2, 1), SP(3, 1), SP(4,1) mentioned in the embodiments above are illustrated as examples, and the control mechanism can be applied to other gate lines GL[k] (k=1~K), source lines S[j] (j=1~J), and subpixels SP(m, n) (m=1~M and n=1~N) on the display panel. Moreover, the color sequence and combinations of the subpixels may vary in practical application. Therefore, the colors of the subpixels are not shown in the following exemplary DG structures.

Figure 8A:
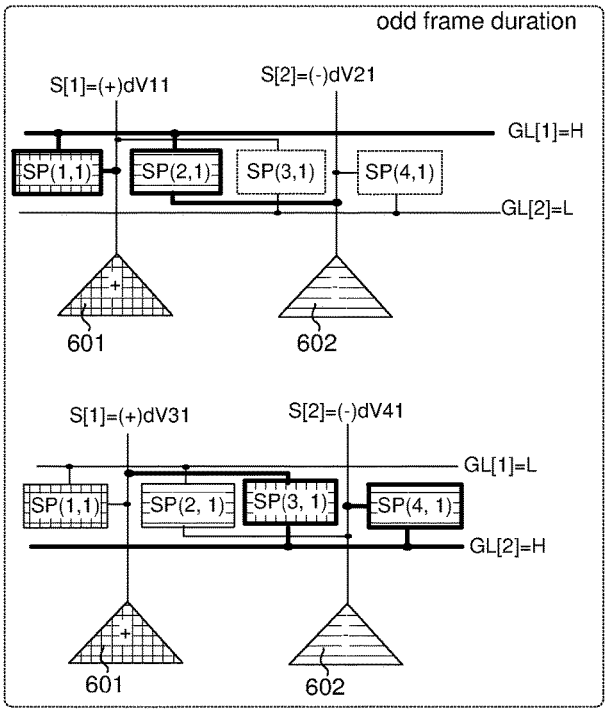
FIGS. 8A and 8B are schematic diagrams illustrating another panel layout and associated control mechanism.
Figure 8B:
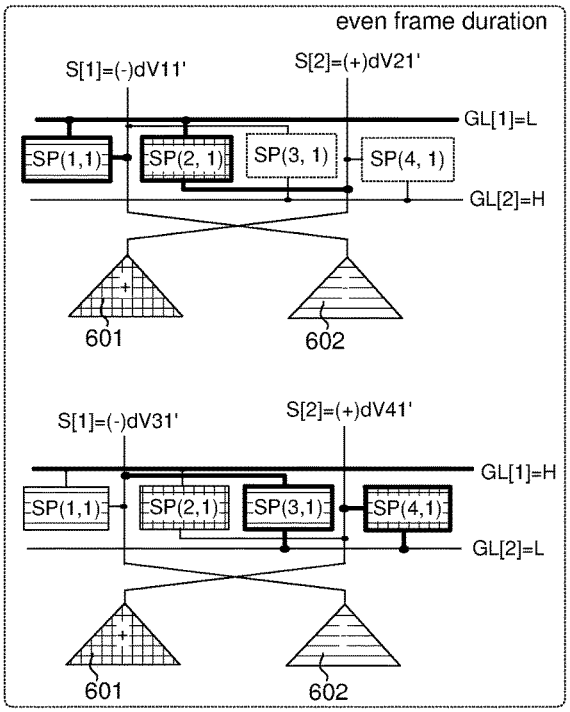

FIGS. 8A and 8B are schematic diagrams illustrating a second exemplary DG structure. The interconnections between the subpixel SP(m, n), the source line S[j] and the gate line GL[k] based on the second exemplary DG structure are summarized in Table 7.

TABLE 7

| second exemplary DG structure | | gate line GL[k] | |
|---|---|---|---|
| FIGS. 8A and 8B | | k = odd | k = even |
| source line S[j] | j = odd | j = (m + 1)/2<br>k = n*2 − 1 | j = (m − 1)/2<br>k = n*2 |
| | j = even | j = m/2 + 1<br>k = n*2 − 1 | j = m/2<br>k = n*2 |

Figure 9B:
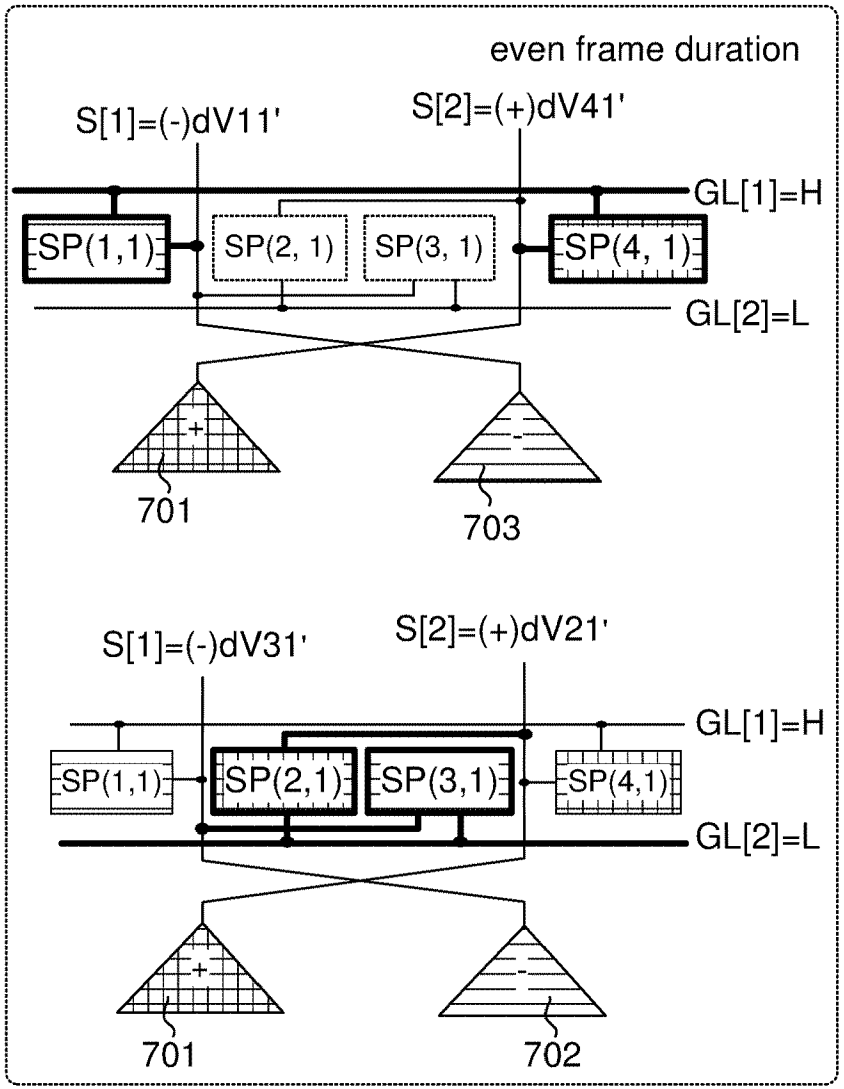
FIG. 9B is a schematic diagram illustrating operations of still another panel layout and associated control mechanism during the even frame duration (Tframe_even).
Figure 9A:
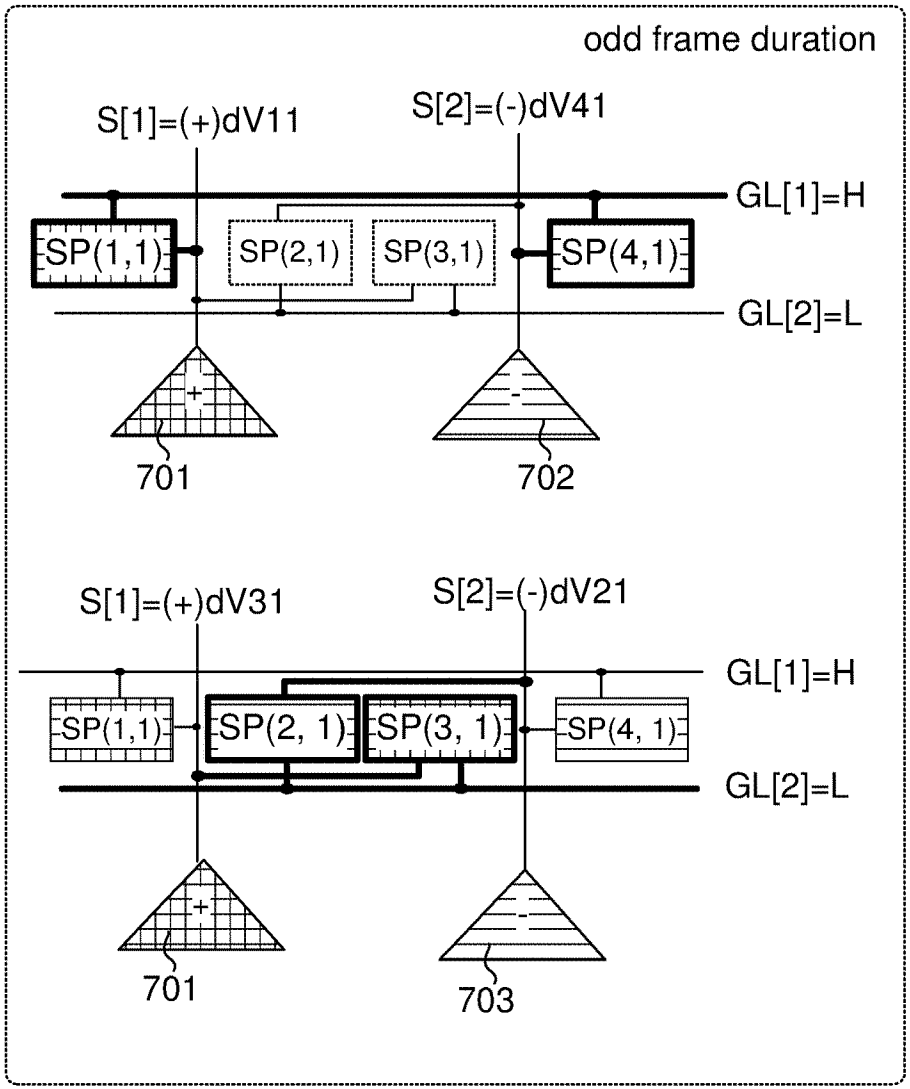
FIG. 9A is a schematic diagram illustrating operations of still another panel layout and associated control mechanism during the odd frame duration (Tframe_odd).

FIGS. 9A and 9B are schematic diagrams illustrating operations of the third exemplary DG structure. The interconnections between the subpixel SP(m, n), the source line S[j] and the gate line GL[k] based on the third exemplary DG structure are summarized in Table 8.

TABLE 8

| third exemplary DG structure | | gate line GL[k] | |
|---|---|---|---|
| FIGS. 9A and 9B | | k = odd | k = even |
| source line S[j] | j = odd | j = (m + 1)/2<br>k = n*2 − 1 | j = (m − 1)/2<br>k = n*2 |
| | j = even | j = m/2<br>k = n*2 − 1 | j = m/2 + 1<br>k = n*2 |

Figure 10A:
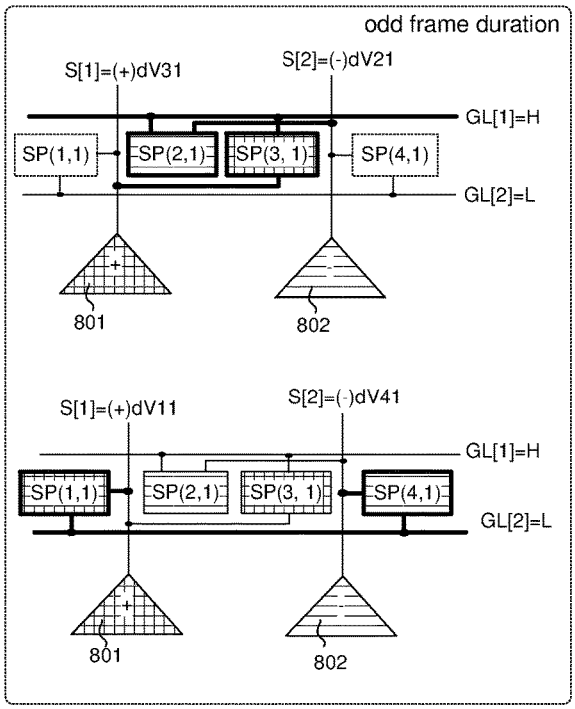
FIG. 10A is a schematic diagram illustrating operations of an alternative panel layout and associated control mechanism during the odd frame duration.
Figure 10B:
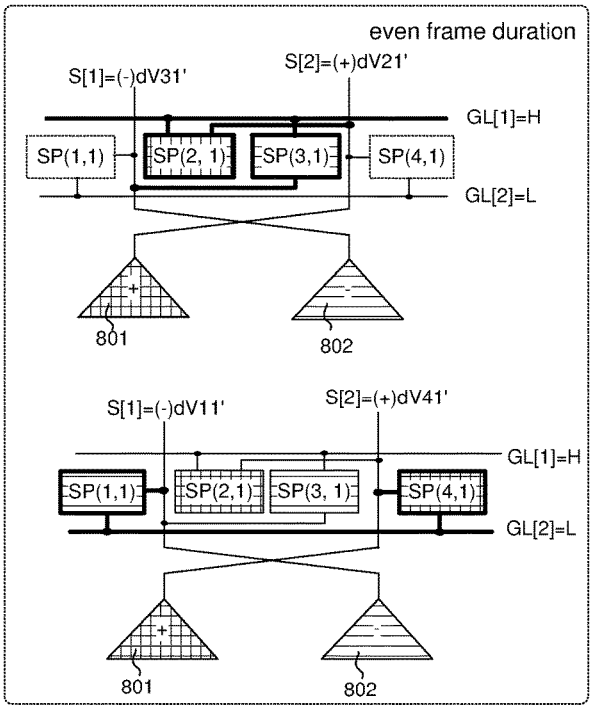
FIG. 10B is a schematic diagram illustrating operations of the alternative panel layout and associated control mechanism during the even frame duration (Tframe_even).

FIGS. 10A and 10B are schematic diagrams illustrating operations of the fourth exemplary DG structure. The interconnections between the subpixel SP(m,n), the source line S[j] and the gate line GL[k] based on the fourth exemplary DG structure are summarized in Table 9.

TABLE 9

| Fourth exemplary DG structure | | gate line GL[k] | |
|---|---|---|---|
| FIGS. 10A, 10B | | k = odd | k = even |
| source line S[j] | j = odd | j = (m − 1)/2<br>k = n*2 − 1 | j = (m + 1)/2<br>k = n*2 |
| | j = even | j = m/2 + 1<br>k = n*2 − 1 | j = m/2<br>k = n*2 |

Four different exemplary DG structures are illustrated above. Based on different viewpoints, some connections rules can be applied to these DG structures.

Depending on the gate lines being connected to, the subpixels can be defined as subpixel groups. The four exemplary DG structure can be classified into two categories, a first category includes the first and the second exemplary DG structures, and a second category includes the third and the fourth exemplary DG structures. Please refer to Table 10 for such classification.

TABLE 10

| first category | | |
|---|---|---|
| subpixels in subpixel group | SP(1, 1) and SP(2, 1) | SP(3, 1) and SP(4, 1) |
| first exemplary DG structure | GL[2] | GL[1] |
| second exemplary DG structure | GL[1] | GL[2] |
| **second category** | | |
| subpixels in subpixel group | SP(1, 1) and SP(4, 1) | SP(2, 1) and SP(3, 1) |
| third exemplary DG structure | GL[1] | GL[2] |
| fourth exemplary DG structure | GL[2] | GL[1] |

For the (first and second) exemplary DG structures belong to the first category, the subpixels SP(1,1)~SP(1,4) can be classified into a subpixel group including subpixels SP(1,1), SP(2,1) and another subpixel group including subpixels SP(3,1), SP(4, 1). For the (third and fourth) exemplary DG structures belong to the second category, the subpixels SP(1,1)~SP(1,4) can be classified into a subpixel group including subpixels SP(1,1), SP(4,1) and another subpixel group including subpixels SP(2,1), SP(3, 1).

Depending on whether the subpixels have similar connections with the gate lines, the four exemplary DG structures can be grouped in another two categories, a third category that the subpixels SP(1, 1), SP(3, 1) are respectively electrically connected to the gate lines GL[1], GL[2], and a fourth category that the subpixels SP(1, 1), SP(3, 1) are respectively electrically connected to the gate lines GL[2], GL[1]. Please refer to Table 11 for such classification.

TABLE 11

| third category | | | | |
|---|---|---|---|---|
| subpixels | SP(1, 1) | SP(2, 1) | SP(3, 1) | SP(4, 1) |
| second exemplary DG structure | GL[1] | GL[1] | GL[2] | GL[2] |
| third exemplary DG structure | | GL[2] | | GL[1] |
| **fourth category** | | | | |
| subpixels | SP(1, 1) | SP(2, 1) | SP(3, 1) | SP(4, 1) |
| first exemplary DG structure | GL[2] | GL[2] | GL[1] | GL[1] |
| fourth exemplary DG structure | | GL[1] | | GL[2] |

For the (second and third) exemplary DG structures belong to the third category, the connections between the gate lines GL[1], GL[2] and the subpixels SP(1, 1), SP(3, 1) are the same, but the connections between the gate lines GL[1], GL[2] and the subpixels SP(2,1), SP(4,1) are interchanged. For the (first and second) exemplary DG structures belong to the fourth category, the connections between the gate lines GL[2], GL[1] and the subpixels SP(1, 1), SP(3, 1) are the same, but the connections between the gate lines GL[1], GL[2] and the subpixels SP(2,1), SP(4,1) are interchanged.

Based on the nature of the DG structure, half of the subpixels SP(m, n) (m=1~M) are electrically connected to the gate line GL[k] (k=2*n−1), and the other half of the subpixels SP(m, n) (m=1~M) are electrically connected to the gate line GL[k] (k=2*n). Furthermore, among the subpixels located at the same row and electrically connected to the same gate line, half of which are located at the odd-numbered columns (m=odd), and the other half of which are located at the even-numbered columns (m=even).

Figure 11A:
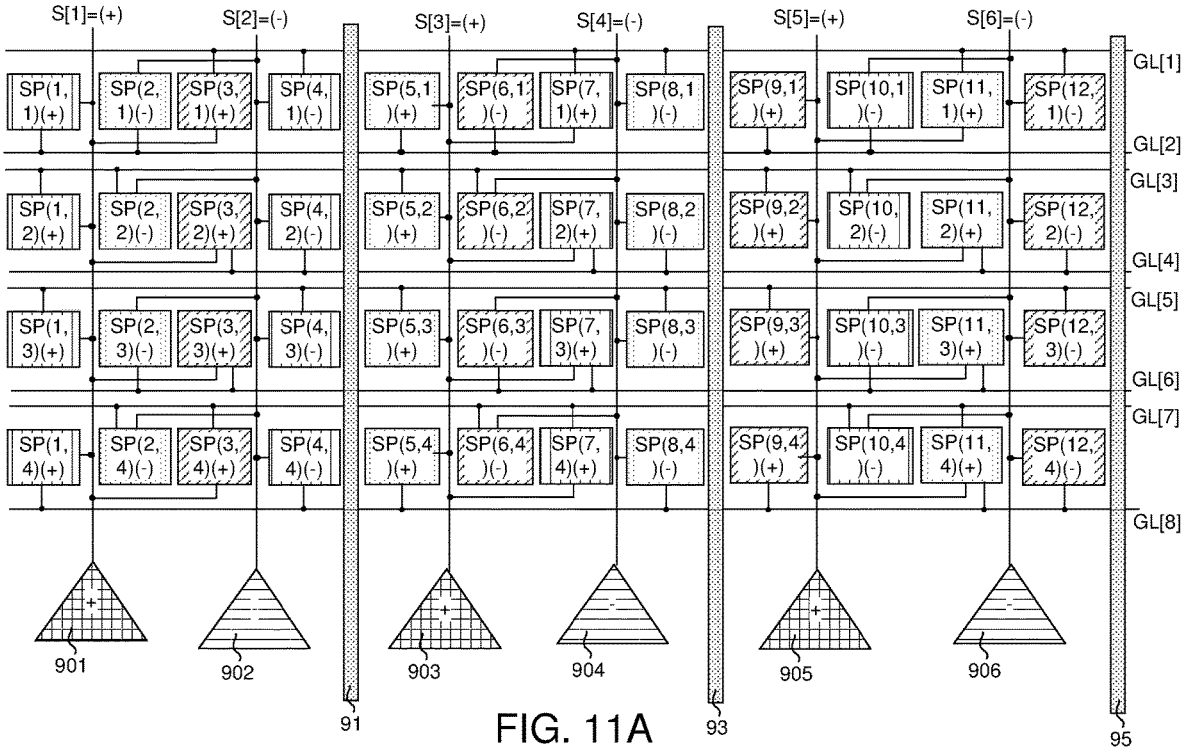
FIGS. 11A and 11B are schematic diagrams showing an exemplary display panel including a mixture of different layout of the subpixels.
Figure 11B:
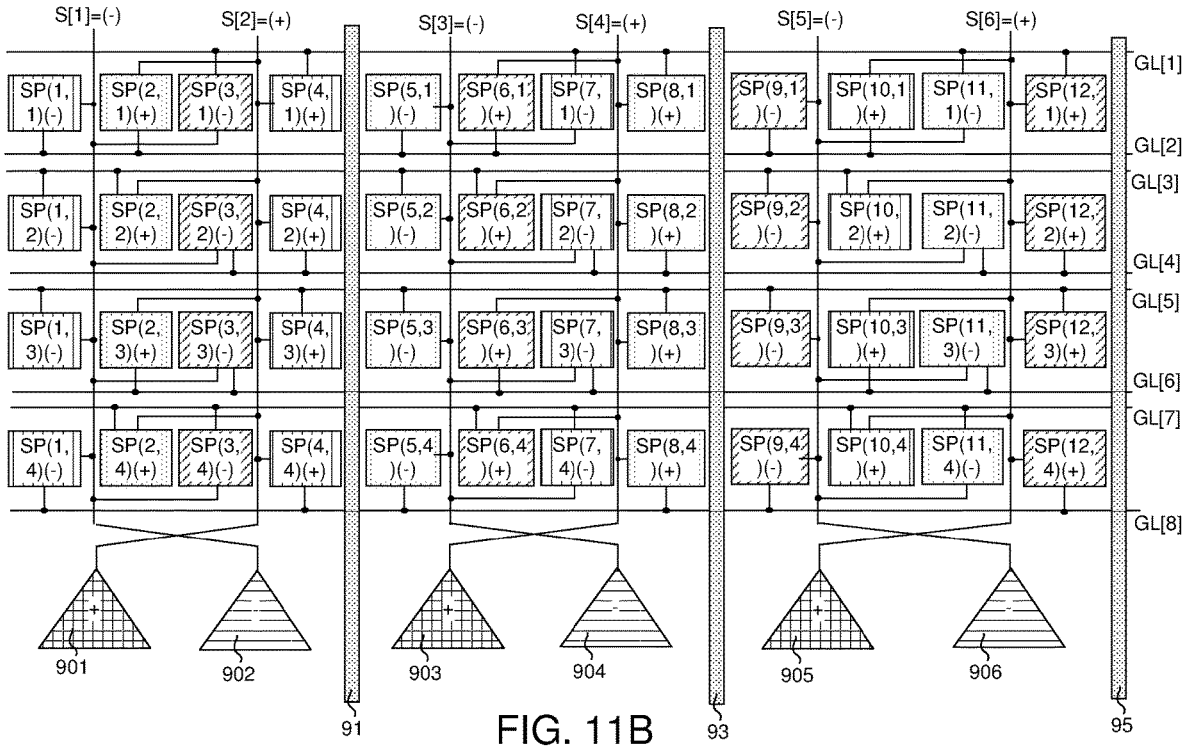

In all the above-mentioned embodiments, the patterns of the connections between the gate lines, the source lines, and the subpixels can be repeatedly adopted in the whole display panel. In practical application, it is also possible to implement one or more different layout in the same display panel. FIGS. 11A and 11B show an example of the display panel having a mixture of the four exemplary DG structures.

FIGS. 11A and 11B are schematic diagrams showing a display panel including a mixture of the exemplary DG structures mentioned above. FIG. 11A is corresponding to the odd frame duration (Tframe_odd) and FIG. 11B is corresponding to the even frame duration (Tframe_even).

Please refer to FIGS. 11A and 11B together. In FIGS. 11A and 11B, the connections between the subpixels and the gate lines GL[1]~GL[8] are different in each row (line). The subpixels at the first row SP(m, n) (m=1~M, and n=1) are arranged according to the first exemplary DG structure. The subpixels at the second row SP(m, n) (m=1~M, and n=2), the subpixels at the third row SP(m, n) (m=1~M, and n=3), and the subpixels at the fourth row SP(m, n) (m=1~M, and n=4) are respectively arranged according to the second, the third, and the fourth exemplary DG structures.

On the other hand, the connections between the subpixels and the source lines S[j] (j=1~J) are not changed with rows. That is, all the subpixels located at the first column and the third column SP(m, n) (m=1 or 3) are electrically connected to the source line S[1], and all the subpixels located at the second column and the fourth column SP(m, n) (m=2 or 4) are electrically connected to the source line S[2]. The supplement of the data voltages can be summarized in Table 12.

TABLE 12

| | SP(m, n) | | | |
|---|---|---|---|---|
| | FIG. 11A | | FIG. 11B | |
| frame duration | odd frame duration (Tframe_odd) | | even frame duration (Tframe_even) | |
| source line S[j] | j = (m + 1)/2 m = odd | j = m/2 m = even | j = (m + 1)/2 m = odd | j = m/2 m = even |
| polarities of data voltages | positive polarity (+) | negative polarity (−) | negative polarity (−) | positive polarity (+) |

During the odd frame duration (Tframe_odd), the driving circuits 901~906 transmit data voltages to source lines SL[1]~S[6] in a sequential and parallel manner. As shown in FIG. 11A, the subpixels located at the odd columns (SP(m, n), m=odd) receive the data voltages with positive polarity (+) through the odd-numbered source lines S[I] (j=(m+1)/2), and the subpixels located at the even columns (SP(m, n), m=even) receive the data voltages with negative polarity (−) through the even-numbered source lines S[j] (j=m/2). During the even frame duration (Tframe_even), the driving circuits 901~906 transmit data voltages to source lines SL[1]~S[6] in a pair and crossed manner. As shown FIG. 11B, the subpixels located at the odd columns (SP(m, n), m=odd) receive the data voltages with negative polarity (−) through the odd source lines S[j] (j=(m+1)/2), and the subpixels located at the even columns (SP(m, n), m=even) receive the data voltages with negative polarity (−) through the even-numbered source lines S[j] (j=m/2). In practical application, the control mechanisms in the odd frame duration (Tframe_odd) and the even frame duration (Tframe_even) may be swapped.

In FIGS. 11A and 11B, none of the touch sensing electrodes 91, 93, 95 crosses over any of the source lines S[1]~S[6], nor the interconnections between the source lines S[1]~S[6] and the subpixels SP(m, n) (m=1~12 and n=1~4), such layout plan can simplify the manufacture procedure of the DG display panel.

Comparing with the conventional DG structure, the subpixels receiving the data voltages having the same polarity are not at adjacent columns. That is, the subpixels at every adjacent column receive data voltages having opposite polarities. Therefore, the potential flicker, caused by the vertical pattern phenomenon when the display panel is shaken, becomes invisible.

According to the embodiments, the odd-numbered source lines S[j](j=odd) receive data voltages having positive polarity during the odd frame duration (Tframe_odd), and receives data voltages having negative polarity during the even frame duration (Tframe_even). As the polarities of the data voltages remain unchanged within the same frame duration, the power loss of caused by voltage shifting of the data voltages is limited to a specific range, and the power loss caused by data voltage switching of the driving circuits can be minimized.

It will be apparent to those skilled in the art that various modifications and variations can be made to the disclosed embodiments. It is intended that the specification and examples be considered as exemplary only, with a true scope of the disclosure being indicated by the following claims and their equivalents.

What is claimed is:

1. A display panel, comprising:

a first subpixel, electrically connected to a first source line and a first gate line;

a second subpixel, electrically connected to a second source line and a second gate line;

a third subpixel, electrically connected to the first source line and the second gate line;

a fourth subpixel, electrically connected to the second source line and the first gate line;

a fifth subpixel, electrically connected to a third source line and the first gate line;

a sixth subpixel, electrically connected to a fourth source line and the second gate line;

a seventh subpixel, electrically connected to the third source line and the second gate line; and an eighth subpixel, electrically connected to the fourth source line and the first gate line, wherein the first, the second, the third, the fourth, the fifth, the sixth, the seventh, and the eighth subpixels are sequentially arranged along a first direction, wherein during a first gate control duration, the first source line conducts a first data voltage having a first polarity to the first subpixel, the second source line conducts a second data voltage having a second polarity to the fourth subpixel, the third source line conducts a third data voltage having the first polarity to the fifth subpixel, the fourth source line conducts a fourth data voltage having the second polarity to the eighth subpixel, wherein the first polarity and the second polarity are opposite.

2. The display panel according to claim 1, wherein the second gate line is set to a first voltage level, and the first gate line is set to a second voltage level during the first gate control duration; and the first gate line is set to the first voltage level, and the second gate line is set to the second voltage level during a second gate control duration.

3. The display panel according to claim 2, wherein during the second gate control duration, the first source line conducts a fifth data voltage having the first polarity to the third subpixel;

the second source line conducts a sixth data voltage having the second polarity to the second subpixel;

the third source line conducts a seventh data voltage having the first polarity to the seventh subpixel;

the fourth source line conducts an eighth data voltage having the second polarity to the sixth subpixel.

4. A display panel according to claim 3, further comprising:

a ninth subpixel, electrically connected to the first source line and a third gate line;

a tenth subpixel, electrically connected to the second source line and a fourth gate line;

an eleventh subpixel, electrically connected to the first source line and the fourth gate line; and a twelfth subpixel, electrically connected to the second source line and the third gate line, wherein during a third gate control duration, the first source line conducts a ninth data voltage having the first polarity to the ninth subpixel; and the second source line conducts a tenth data voltage having the second polarity the twelfth subpixel.

5. The display panel according to claim 4, wherein during a fourth gate control duration, the first source line conducts an eleventh data voltage having the first polarity to the eleventh subpixel; and the second source line conducts a twelfth data voltage having the second polarity to the tenth subpixel.

6. The display panel according to claim 1, wherein the first gate line and the second gate line are parallel to the first direction, and the first source line, the second source line, the third source line, and the fourth source line are parallel to a second direction, wherein the first direction and the second direction are orthogonal.

7. The display panel according to claim 6, wherein the first gate line is placed along a first side of the first, the second, the third, the fourth, the fifth, the sixth, the seventh, and the eighth subpixels;

the second gate line is placed along a second side of the first, the second, the third, the fourth, the fifth, the sixth, the seventh, and the eighth subpixels;

the first source line is placed in between the first subpixel and the second subpixel;

the second source line is placed in between the third subpixel and the fourth subpixel;

the third source line is placed in between the fifth subpixel and the sixth subpixel; and the fourth source line is placed in between the seventh subpixel and the eighth subpixel.

8. The display panel according to claim 1, wherein during a first frame duration, the first source line receives the first data voltage from a first driving circuit, the second source line receives the second data voltage from a second driving circuit, the third source line receives the third data voltage from a third driving circuit, and the fourth source line receives the fourth data voltage from a fourth driving circuit.

9. A control circuit, electrically connected to a display panel comprising a first subpixel, a second subpixel, a third subpixel, a fourth subpixel, a fifth subpixel, a sixth subpixel, a seventh subpixel, and an eighth subpixel, wherein the first, the second, the third, the fourth, the fifth, the sixth, the seventh, and the eighth subpixels are sequentially arranged along a first direction, and the control circuit comprises:

a source driver, comprising:

a first source line, electrically connected to the first subpixel and the third subpixel;

a second source line, electrically connected to the second subpixel and the fourth subpixel;

a third source line, electrically connected to the fifth subpixel and the seventh subpixel;

a fourth source line, electrically connected to the sixth subpixel and the eighth subpixel;

a first driving circuit;

a second driving circuit;

a third driving circuit; and a fourth driving circuit; and a gate driver, comprising:

a first gate line, electrically connected to the first subpixel, the fourth subpixel, the fifth subpixel, and the eighth subpixel; and a second gate line, electrically connected to the second subpixel, the third subpixel, the sixth subpixel, and the seventh subpixel, wherein during a first gate control duration, the first driving circuit provides a first data voltage having a first polarity to the first subpixel through the first source line, the second driving circuit provides a second data voltage having a second polarity to the fourth subpixel through the second source line, the third driving circuit provides a third data voltage having the first polarity to the fifth subpixel to the third source line, and the fourth driving circuit provides a fourth data voltage having the second polarity to the eighth subpixel through the fourth source line, wherein the first polarity and the second polarity are opposite.

10. The control circuit according to claim 9, wherein the gate driver further comprises:

a first shift control circuit, electrically connected to the first gate line; and a second shift control circuit, electrically connected to the second gate line, wherein the second shift control circuit sets the second gate line to a first voltage level, and the first shift control circuit sets the first gate line to a second voltage level during the first gate control duration, the first shift control circuit sets the first gate line to the first voltage level and the second shift control circuit sets the second gate line to the second voltage level during a second gate control duration.

11. The display panel according to claim 10, wherein during the second gate control duration, the first driving circuit provides a fifth data voltage having the first polarity to the third subpixel through the first source line, the second driving circuit provides a sixth data voltage having the second polarity to the second subpixel through the second source line, the third driving circuit provides a seventh data voltage having the first polarity to the seventh subpixel through the third source line, and the fourth driving circuit provides an eighth data voltage having the second polarity to the sixth subpixel through the fourth source line.

12. The control circuit according to claim 10, wherein the display panel further comprises a ninth subpixel being electrically connected to the first source line and a third gate line, a tenth subpixel being electrically connected to the second source line and a fourth gate line, an eleventh subpixel being electrically connected to the first source line and the fourth gate line, and a twelfth subpixel being electrically connected to the second source line and the third gate line, wherein during a third gate control duration, the first driving circuit provides a ninth data voltage having the first polarity to the ninth subpixel through the first source line, and the second driving circuit provides a tenth data voltage having the second polarity to the twelfth subpixel through the second source line; and, during a fourth gate control duration, the first driving circuit provides an eleventh data voltage having the first polarity to the eleventh subpixel through the first source line, and the second driving circuit provides a twelfth data voltage having the second polarity to the tenth subpixel through the second source line.

13. The control circuit according to claim 9, wherein the source driver further comprises:

a first switch, electrically connected to the first driving circuit and the first source line, configured to selectively connect the first driving circuit and the first source line;

a second switch, electrically connected to the second driving circuit and the second source line, configured to selectively connect the second driving circuit and the second source line;

a third switch, electrically connected to the second driving circuit and the first source line, configured to selectively connect the second driving circuit and the first source line;

a fourth switch, electrically connected to the first driving circuit and the second source line, configured to selectively connect the first driving circuit and the second source line;

a fifth switch, electrically connected to the third driving circuit and the third source line, configured to selectively connect the third driving circuit and the third source line;

a sixth switch, electrically connected to the fourth driving circuit and the fourth source line, configured to selectively connect the fourth driving circuit and the fourth source line;

a seventh switch, electrically connected to the fourth driving circuit and the third source line, configured to selectively connect the fourth driving circuit and the third source line; and an eighth switch, electrically connected to the third driving circuit and the fourth source line, configured to selectively connect the third driving circuit and the fourth source line, wherein the first, the second, the fifth, and the sixth switches are turned on during a first frame duration, and the third, the fourth, the seventh, and the eighth switches are turned on during a second frame duration.

14. A display device, comprising:

a display panel, comprising a first subpixel, a second subpixel, a third subpixel, a fourth subpixel, a fifth subpixel, a sixth subpixel, a seventh subpixel, and an eighth subpixel, wherein the first, the second, the third, the fourth, the fifth, the sixth, the seventh, and the eighth subpixels are sequentially arranged along a first direction; and a control circuit, comprising:

a source driver, comprising:

a first source line, electrically connected to the first subpixel and the third subpixel;

a second source line, electrically connected to the second subpixel and the fourth subpixel;

a third source line, electrically connected to the fifth subpixel and the seventh subpixel;

a fourth source line, electrically connected to the sixth subpixel and the eighth subpixel;

a first driving circuit, electrically connected to the first source line during a first frame duration and electrically connected to the second source line during a second frame duration;

a second driving circuit, electrically connected to the second source line during the first frame duration and electrically connected to the first source line during the second frame duration;

a third driving circuit, electrically connected to the third source line during the first frame duration and electrically connected to the fourth source line during the second frame duration;

a fourth driving circuit, electrically connected to the fourth source line during the first frame duration and electrically connected to the third source line during the second frame duration; and a gate driver, comprising:

a first gate line, electrically connected to the first subpixel, the fourth subpixel, the fifth subpixel, and the eighth subpixel; and a second gate line, electrically connected to the second subpixel, the third subpixel, the sixth subpixel, and the seventh subpixel, wherein during a first gate control duration, the first driving circuit provides a first data voltage having a first polarity to the first subpixel through the first source line, the second driving circuit provides a second data voltage having a second polarity to the fourth subpixel through the second source line, the third driving circuit provides a third data voltage having the first polarity to the fifth subpixel to the third source line, and the fourth driving circuit provides a fourth data voltage having the second polarity to the eighth subpixel through the fourth source line, wherein the first polarity and the second polarity are opposite.

15. The display device according to claim 14, wherein the gate driver further comprises:

a first shift control circuit, electrically connected to the first gate line; and a second shift control circuit, electrically connected to the second gate line, wherein the second shift control circuit sets the second gate line to a first voltage level, and the first shift control circuit sets the first gate line to a second voltage level during the first gate control duration, the first shift control circuit sets the first gate line to the first voltage level and the second shift control circuit sets the second gate line to the second voltage level during a second gate control duration.

16. The display device according to claim 15, wherein during the second gate control duration, the first driving circuit provides a fifth data voltage having the first polarity to the third subpixel through the first source line, the second driving circuit provides a sixth data voltage having the second polarity to the second subpixel through the second source line, the third driving circuit provides a seventh data voltage having the first polarity to the third subpixel through the third source line, and the fourth driving circuit provides an eighth data voltage having the second polarity to the sixth subpixel through the fourth source line.

17. The display device according to claim 15, wherein the display panel further comprises a ninth subpixel being electrically connected to the first source line and a third gate line, a tenth subpixel being electrically connected to the second source line and a fourth gate line, an eleventh subpixel being electrically connected to the first source line and the fourth gate line, and a twelfth subpixel being electrically connected to the second source line and the third gate line, wherein during a third gate control duration, the first driving circuit provides a ninth data voltage having the first polarity to the ninth subpixel through the first source line, and the second driving circuit provides a tenth data voltage having the second polarity to the twelfth subpixel through the second source line; and, during a fourth gate control duration, the first driving circuit provides an eleventh data voltage having the first polarity to the eleventh subpixel through the first source line, and the second driving circuit provides a twelfth data voltage having the second polarity to the tenth subpixel through the second source line.

* * * * *